United States Patent [19]

Herter et al.

[11] Patent Number: 4,830,586

[45] Date of Patent: May 16, 1989

[54] DOUBLE ACTING DIAPHRAGM PUMP

[75] Inventors: Rolf Herter; C. Bernard Sartran, both of Ratingen; Arno Grabowski, Dusseldorf, all of Fed. Rep. of Germany

[73] Assignee: The ARO Corporation, Bryan, Ohio

[21] Appl. No.: 136,092

[22] Filed: Dec. 21, 1987

[51] Int. Cl.[4] ..... F04B 23/06; F04B 43/06

[52] U.S. Cl. ..... 417/395; 417/397

[58] Field of Search ..... 417/393, 395, 397, 403, 417/396, 404

[56] References Cited

U.S. PATENT DOCUMENTS 1,820,236 8/1931 Loud ..... 417/397 X
2,564,052 8/1951 Chiville, Jr. ..... 417/393 X
4,068,476 1/1978 Kelsey ..... 417/404 X
4,229,143 10/1980 Pucher et al. ..... 417/392 X

FOREIGN PATENT DOCUMENTS 0567394 4/1925 France ..... 417/397

*Primary Examiner*—Leonard E. Smith
*Assistant Examiner*—Eugene L. Szczecina, Jr.
*Attorney, Agent, or Firm*—Allegretti & Witcoff, Ltd.

[57] ABSTRACT

An improved double acting diaphragm pump utilizes at least one supplemental diaphragm and associated pressure chamber arranged coaxially with the connecting shaft of the main diaphragms. The supplemental chambers are connected via parallel pressure lines or conduits to the pressure source for the main diaphragms and associated pressure chambers.

3 Claims, 3 Drawing Sheets

PRIOR ART DIAPHRAGM PUMP

DOUBLE ACTING DIAPHRAGM PUMP

BACKGROUND OF THE INVENTION

In a principal aspect, the present invention relates to an improved double acting diaphragm pump and, more particularly, to a double acting diaphragm pump wherein the pumping force upon the fluid which is to be pumped exceeds the force attributable to pneumatic or other fluid pressure directly on the diaphragm. Such pumps are often called 2:1, 3:1, etc. diaphragm pumps.

Heretofore a double acting diaphragm pump typically includes first and second, main diaphragms each of which separate a pump chamber from a pressure chamber. The pump chamber receives the fluid or material pumped or transported and the pressure chamber receives pressurized fluid such as air that acts upon the diaphragm to effect flexure and thus pumping action. The separate diaphragms for a double acting diaphragm pump are generally connected by a shaft so that the diaphragms will reciprocate in unison in a manner which alternately provides pumping of fluid from one of the pump chambers or the other. Since the two pump chambers are connected to a common inlet manifold and a common outlet manifold, a continuous flow of fluid into the inlet manifold and from the outlet manifold is provided by the described operation of the pump.

The force to effect the pumping action by such a pump is equal to the area of the diaphragm times the pressure per unit of area of the diaphragm. Thus, in a double acting diaphragm pump which provides a continuous output, the pumping force is limited by the area of the main diaphragm.

There has, therefore, been a need to enhance the pumping force. Heretofore a known double acting diaphragm pump which provides for enhanced pumping force on fluid in the pumping chamber includes a separate, enlarged fluid pressure diaphragm mechanically connected to a spaced main pumping diaphragm by a shaft. The separate fluid pressure diaphragm has a surface area which is greater than the main pumping diaphragm thus providing an increased pumping force through the mechanical shaft connection to the main pumping diaphragm.

Nonetheless, there has remained a need to provide an improved, double acting, diaphragm pump of simplified construction and operation, having a fewer number of parts than prior art double acting diaphragm pumps, and also capable of providing enhanced pressure for pumping fluid.

SUMMARY OF THE INVENTION

Briefly, the present invention relates to a double acting diaphragm pump of the type which includes a pair of flexible diaphragms interconnected by a shaft and operative to reciprocate in response to pressure on one or the other of the diaphragms to effect pumping through a first pumping chamber associated with one diaphragm and a second pumping chamber associated with the other diaphragm. Thereby a continuous fluid input and output is effected by the double acting diaphragm pump. The invention specifically relates to the improvement of a supplemental pressure chamber defined, in part, by a supplemental diaphragm which provides an additive pumping force to the main diaphragm via a connected shaft means. The additive force is synchronized with the force derived from pressure on the appropriate main diaphragm. Such synchronization is effected by means of a parallel fluid pressure conduit connection to the supplemental chamber and the pressure chamber. In this manner, additive force may be provided for each of the pumping chambers. Additional supplemental chambers connected in parallel in the manner described may provide further additive forces for pumping.

Thus, it is an object of the present invention to provide an improved, double acting, diaphragm pump.

A further object of the invention is to provide an improved double acting diaphragm pump which incorporates a supplemental pressure chamber and diaphragm operative in parallel with a main diaphragm and pressure chamber.

Yet a further object of the invention is to provide an improved double acting diaphragm pump which provides for enhanced pumping capacity with a minimum amount of modification relative to prior art pumps.

Another object of the invention is to provide a double acting diaphragm pump having a simple construction which includes a means for increased pumping force to enhance the pumping action of the pump.

Yet another object of the invention is to provide a double acting diaphragm pump having a simplified construction which is efficient, easy to operate, and which is compact and mechanically simple.

These and other objects, advantages and features of the invention will be set forth in the detailed description which follows.

BRIEF DESCRIPTION OF THE DRAWING

In the detailed description which follows, reference will be made to the drawing comprised of the following figures.

DESCRIPTION OF THE PREFERRED EMBODIMENT

Figure 1:
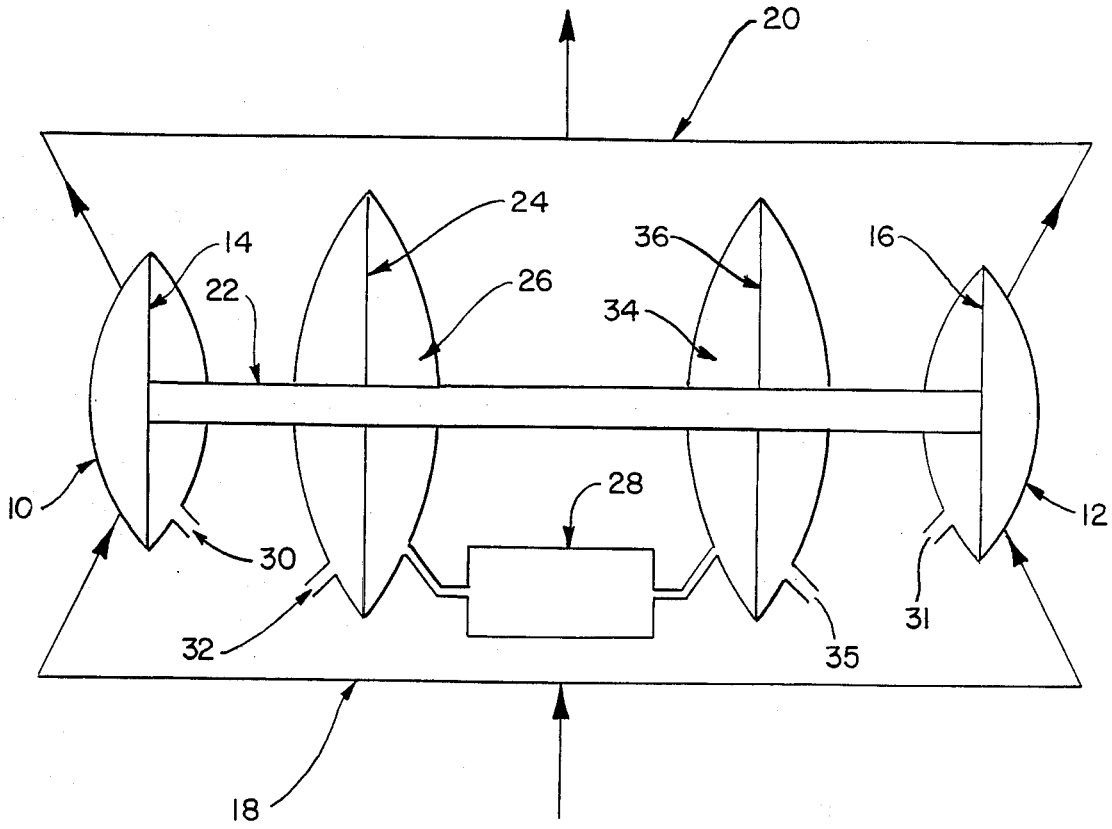
FIG. 1 is a schematic cross sectional view of a known prior art double acting diaphragm pump incorporating a mechanism to provide for increased force for pumping.

FIG. 1 illustrates a prior art, double acting diaphragm pump wherein the pumping force imparted through the flexible diaphragm defining a wall of the pumping chamber to the contents of the pumping chamber is increased mechanically. Specifically, the double acting diaphragm pump includes a first pumping chamber 10 and a second pumping chamber 12, each chamber having a flexible diaphragm 14 and 16, respectively, which is flexed to pump fluid through the chambers 10 or 12. Fluid thus enters from an inlet manifold 18, flows into an appropriate chamber 10 or 12 and is pumped through an outlet manifold 20. Pumping is effected from the chambers 10 and 12 alternatively so that fluid is continuously pumped from the inlet manifold 18 through the outlet manifold 20.

The force to flex the diaphragm 14 is effected mechanically through a shaft 22 which is driven by a separate, greater surface area diaphragm 24. Thus, fluid pressure is provided on a surface of the diaphragm 24 by flow into a pressure chamber 26 from control means and pressure source 28. The surface area of the diaphragm 24 within the chamber 26 is significantly greater than that of the diaphragm 14. As such the pumping force imparted via shaft 22 on the diaphragm 14 is increased relative to equal pressure over the surface area of diaphragm 14. Note that the back side of the diaphragm 14 and the back side of the diaphragm 24 both connect to atmosphere or exhaust via passages 30 and 32.

In a similar fashion, the pumping diaphragm 16 is operated by means of mechanical force imparted through the shaft 22 in response to pressure acting within a chamber 34 against an enlarged diaphragm 36. Again, the area of the diaphragm 36 determines the effective force imparted for pumping fluids by means of flexure of diaphragm 16 in chamber 12, and the back side of diaphragm 16 and diaphragm 36 are vented to the atmosphere via passages 31, 33 respectively.

FIG. 1 thus constitutes a prior art double acting diaphragm pump wherein the pressure chamber has a diaphragm with a larger surface area than the diaphragm for the pumping chamber. In this manner the effective force for pumping is increased.

Figure 2:
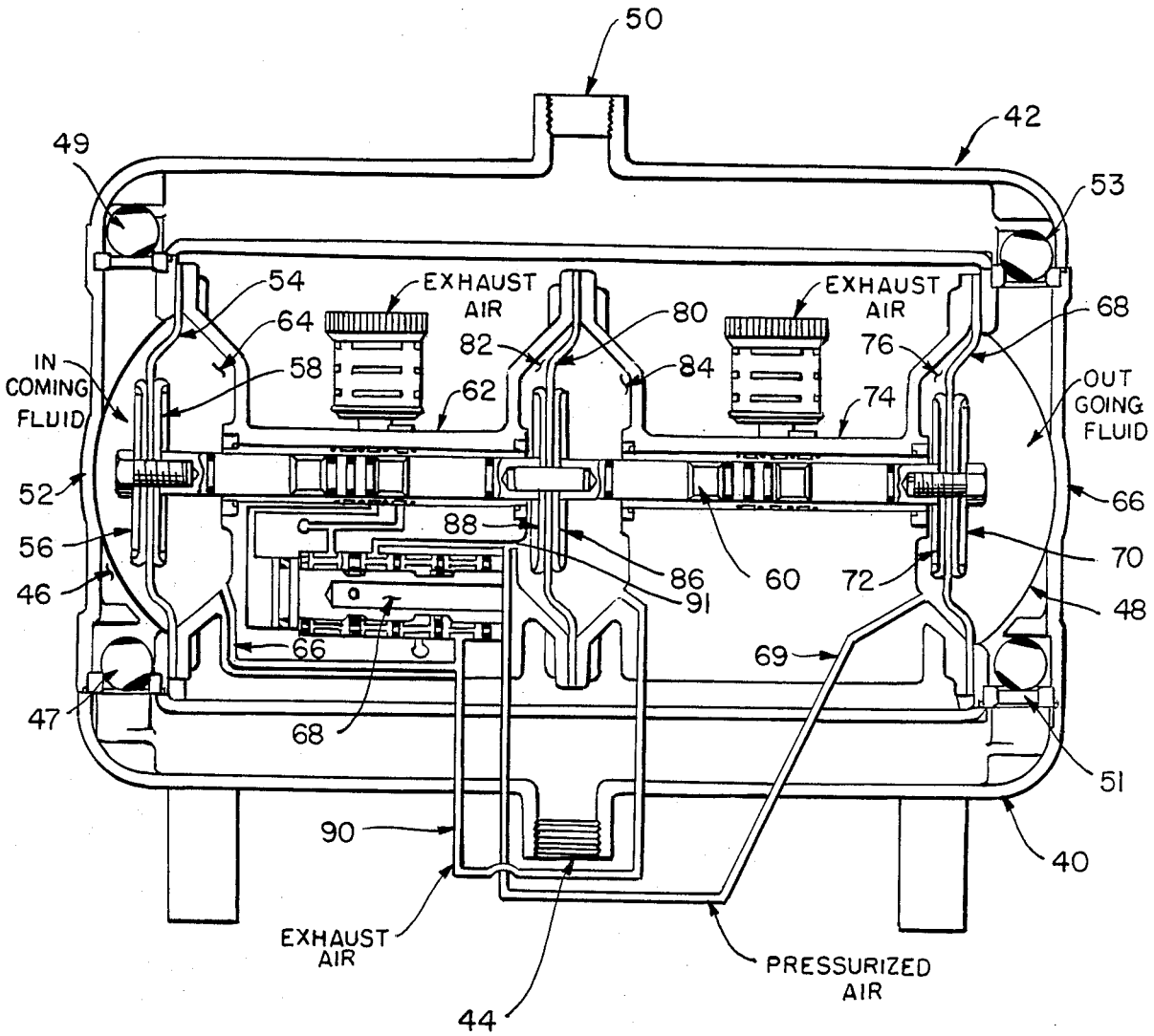
FIG. 2 is a cross sectional view of an embodiment of the improved double acting diaphragm pump of the present invention.
Figure 3:
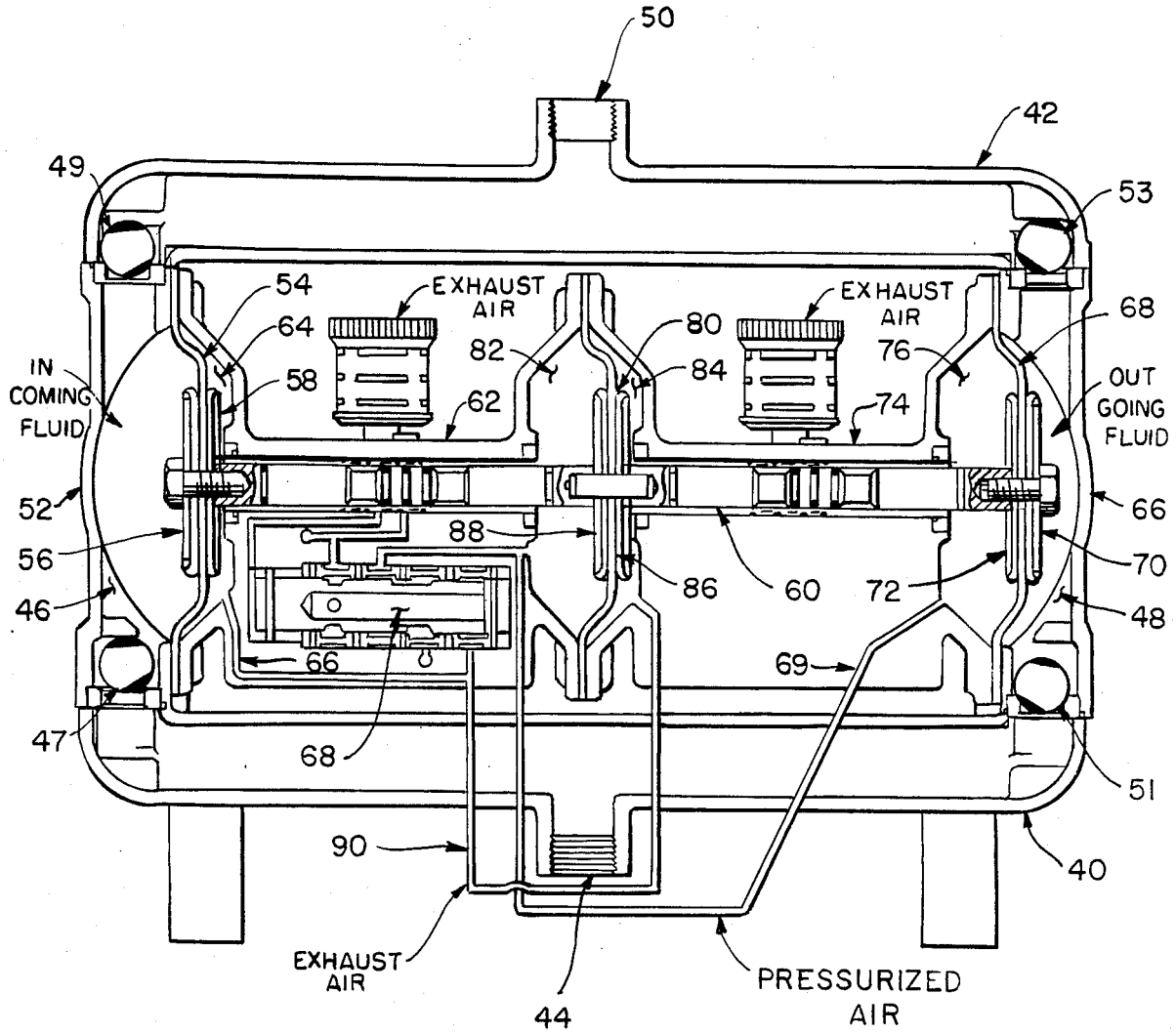
FIG. 3 is a cross sectional view similar to FIG. 2 illustrating sequential operation of the pump of FIG. 2.

The present invention is represented by FIGS. 2 and 3 and constitutes an improvement relative to the construction depicted in FIG. 1. The present invention thus relates to a double acting diaphragm pump. As shown in FIGS. 2 and 3, the double acting diaphragm pump of the invention includes an inlet manifold 40 and an outlet manifold 42. Fluid flows through an inlet 44 into the inlet manifold 40 and thence into one of two pumping chambers 46 or 48. Fluid from the chambers 46 or 48 then flows into the outlet manifold 42 and subsequently through outlet 50. Fluid is pumped alternately from pumping chamber 46 and from pumping chamber 48. In this manner fluid is continuously pumped from the inlet 44 through the outlet 50 as the fluid alternatively is pumped via chambers 46 and 48. As known to those of ordinary skill in the art, check valves 47, 49, 51, 53 are provided at the entrance and exit of each chamber 46, 48 to control the direction of fluid flow through the chambers 46, 48 from the inlet manifold 40 to the outlet manifold 42 as the diaphragms 54, 68 associated with the pumping chambers flex to effect fluid flow.

The construction of each of the chambers 46 and 48 is substantially the same. Chamber 46 is formed, in part, by a housing 52, and a flexible diaphragm 54 which is a main diaphragm 54 that cooperates with housing 52. Diaphragm 54 is sandwiched between plates 56, 58 which connect to a shaft 60. The shaft 60 reciprocates within a second housing 62. The second housing 62 and diaphragm 54 further define a pressure chamber 64. A fluid pressure conduit 66 connects from a pilot control valve assembly 68 to chamber 64 and provides high pressure fluid to the chamber 64 that acts against the surface area of the diaphragm 54 causing operation or flexure of the diaphragm 54 and pumping of fluid through chamber 46. Alternately, conduit 66 connects to an exhaust as controlled by assembly 68.

In a similar fashion, chamber 48 is defined by a housing 66 and a main flexible diaphragm 68. The diaphragm 68 is held between plates 70 and 72 which attach with the shaft 60. The shaft 60 is further retained within a housing 74 which defines a second pressure chamber 76. A fluid conduit 69 connects to the second pressure chamber 76 by way of the control mechanism 68. Conduit 69 may also connect to exhaust. The chambers 64 and 76 are alternatively pressurized and the diaphragms 68 and 54 alternatively flex in reciprocal fashion to cause fluid to flow into the chambers 46 and from the chambers 48 or vice versa. The operation and flow of pressure to the chambers 64 and 76 via conduits 66, 69 is effected by the control means 68.

The improvement of the present invention constitutes the inclusion of supplemental pressure chambers 82, 84, defined by the housing 62 and 74, in combination with an additional supplemental flexible diaphragm 80. Diaphragm 80 separates the supplemental pressure chambers 82 and 84 and is generally coaxial with the chambers 46 and 48 and the shaft 60. Thus, the supplemental flexible diaphragm 80 is sandwiched between plates 86 and 88 that connect with the shaft 60. This assembly reciprocates in unison with the shaft 60. The direction of movement of the diaphragm 80 within the supplemental pressure chambers 82 and 84 is determined by the pressure acting on diaphragm 80 which, in turn, is a function of control means 68 and the connection thereof through appropriate conduits to chambers 82, 84. Specifically, conduit 66 is in parallel relation with a conduit 90 to chamber 84 so that chamber 84 is pressurized simultaneously with chamber 64.

In like fashion, the chamber 82 is connected in parallel via conduit 91 with the chamber 76. In this manner, the chambers 64 and 84 are simultaneously pressurized and the force of fluid pressure within those chambers 64, 84 acts on the diaphragms 54, 80 and through the shaft 60 against fluid within the chamber 46.

If the diaphragm 80 has a surface area exactly equal to that of the diaphragm 54, then the total force on the fluid within the chamber 46 is twice that of a typical prior art pump that does not include the diaphragm 80—in other words, a typical double acting diaphragm pump. Similarly, the pressure on fluid within the chamber 48 would be doubled due to pressure in chambers 82 and 76.

The diaphragm 80 is thus typically circular and concentric with the shaft 60. The shaft 60 reciprocates back and forth and acts to transmit force and movement of the various diaphragms as each of the chambers 62, 82, 84 and 76 are alternately filled with pressurized air or fluid and connected to exhaust. Note that the surface area or effective surface area of the diaphragm 80 may be of any desired size in order to thereby control the additive force imparted to the shaft 60. For example, the area of the diaphragm 80 may be twice that of the area of the diaphragm 64. Alternatively, the area of the diaphragm 80 may be one half that of the area of the diaphragm 64.

Also, a plurality of diaphragms providing supplemental pressure may be arranged along the axis of the shaft 60. That is, a plurality of supplemental diaphragms 80 and associated supplemental chambers may be arranged in parallel arrangement along the axis of the shaft 60, each of the supplemental chambers associated with a supplemental diaphragm being appropriately connected with a pressure source in parallel with the main pressure chamber to drive the shaft 60 and provide pressure to the appropriate pumping chamber.

FIG. 2 illustrates a pumping stroke to the left for pumping from chamber 46. FIG. 3 illustrates a subsequent cycle of the operation of the diaphragms associated with the diaphragm pump of the invention. In FIG. 2, for example, incoming fluid flows into chamber 48 as fluid is pumped from chamber 46 through the outlet 50. In FIG. 3, fluid is pumped from the chamber 48 through the outlet 50 and which fluid flows into the chamber 46 from the inlet 44.

Other variations of the invention are possible. Thus, while there has been set forth a preferred embodiment of the invention, it is to be understood that the invention is to be limited only by the following claims and their equivalents.

What is claimed is:

1. In a double acting diaphragm pump of the type including first and second pumping chambers for alternately receiving and discharging a fluid which is to be pumped, said first and second pumping chambers having a wall thereof defined by first and second flexible main diaphragms, respectively, each of said first and second flexible main diaphragms having a surface for contact with said fluid, said first and second flexible main diaphragms also having another surface in communication with first and second pressure chambers, respectively, for receipt of a pressurized fluid to effect pumping, said pump further including source means for providing said pressurized fluid alternately to said first and second pressure chambers, said first and second flexible main diaphragms being mechanically connected by shaft means to thereby move in unison and reciprocate and alternately effect ingress and egress of said fluid to and from said first and second pumping chambers, the improvement comprising, in combination:

at least one supplemental pressure housing including first and second supplemental fluid pressure chambers and a supplement flexible diaphragm, each of said first and second supplemental fluid pressure chambers having a wall thereof defined by said supplemental flexible diaphragm, said supplemental flexible diaphragm being connected to the shaft means for movement therewith; and fluid conduit means for connecting said source means with said second supplemental fluid pressure chamber in parallel with said first pumping chamber and for connecting said source means with said first supplemental fluid pressure chamber in parallel with said second pumping chamber, thereby effecting an additive pumping force associated with the supplemental flexible diaphragm and driving said shaft means for pumping by said first and second pumping chambers.

2. The improved double acting diaphragm pump of claim 1 wherein the areas of said first and second flexible main diaphragms and said supplemental flexible diaphragm are substantially equal to provide a pumping force which is an integral number of the force associate with said first and second flexible main diaphragms.

3. The improved double acting diaphragm pump of claim 1 wherein said supplemental flexible diaphragm has an area which is an integral multiple of the area of said first flexible main diaphragm.

* * * * *